United States Patent [19]

Santilli et al.

[11] 4,315,184

[45] Feb. 9, 1982

[54] IMAGE TUBE

[75] Inventors: Vincent J. Santilli, Corning; Donald R. Quinn, Horseheads, both of N.Y.

[73] Assignee: Westinghouse Electric Corp., Pittsburgh, Pa.

[21] Appl. No.: 114,187

[22] Filed: Jan. 22, 1980

[51] Int. Cl.[3] ..... H01J 40/00

[52] U.S. Cl. ..... 313/94; 250/213 VT; 313/101; 313/102

[58] Field of Search ..... 313/94, 99, 101, 102; 250/213 VT

[56] References Cited

U.S. PATENT DOCUMENTS

| | | | |
|---|---|---|---|
| Re. 28,751 | 3/1976 | Ball | 250/213 VT |
| 3,683,194 | 8/1972 | Levin et al. | 250/213 VT |
| 3,693,018 | 9/1972 | Spicer | 250/213 VT |
| 3,716,713 | 2/1973 | Levin | 250/213 VT |
| 3,795,531 | 3/1974 | Spicer | 250/213 VT |
| 3,801,849 | 4/1974 | Edgecumbe | 313/102 |
| 3,916,240 | 10/1975 | Cuelenaere et al. | 313/102 |
| 4,087,683 | 5/1978 | Lieb | 313/102 |

*Primary Examiner*—Davis L. Willis
*Attorney, Agent, or Firm*—W. G. Sutcliff

[57] ABSTRACT

An improved image tube operable at higher voltage and gain with low noise levels wherein the electrodes include rolled end portions which extend away from the tube axis, and wherein all electrode surfaces are coated with light absorptive, low secondary electron emission characteristic, insulating material. Annular shields are disposed proximate an inlet and outlet tubulation to prevent deposition of alkali on the interior insulating ceramic envelope surfaces. An improved zoom electrode structure is provided which intercepts stray electrons while passing the focused beam to the target.

3 Claims, 1 Drawing Figure

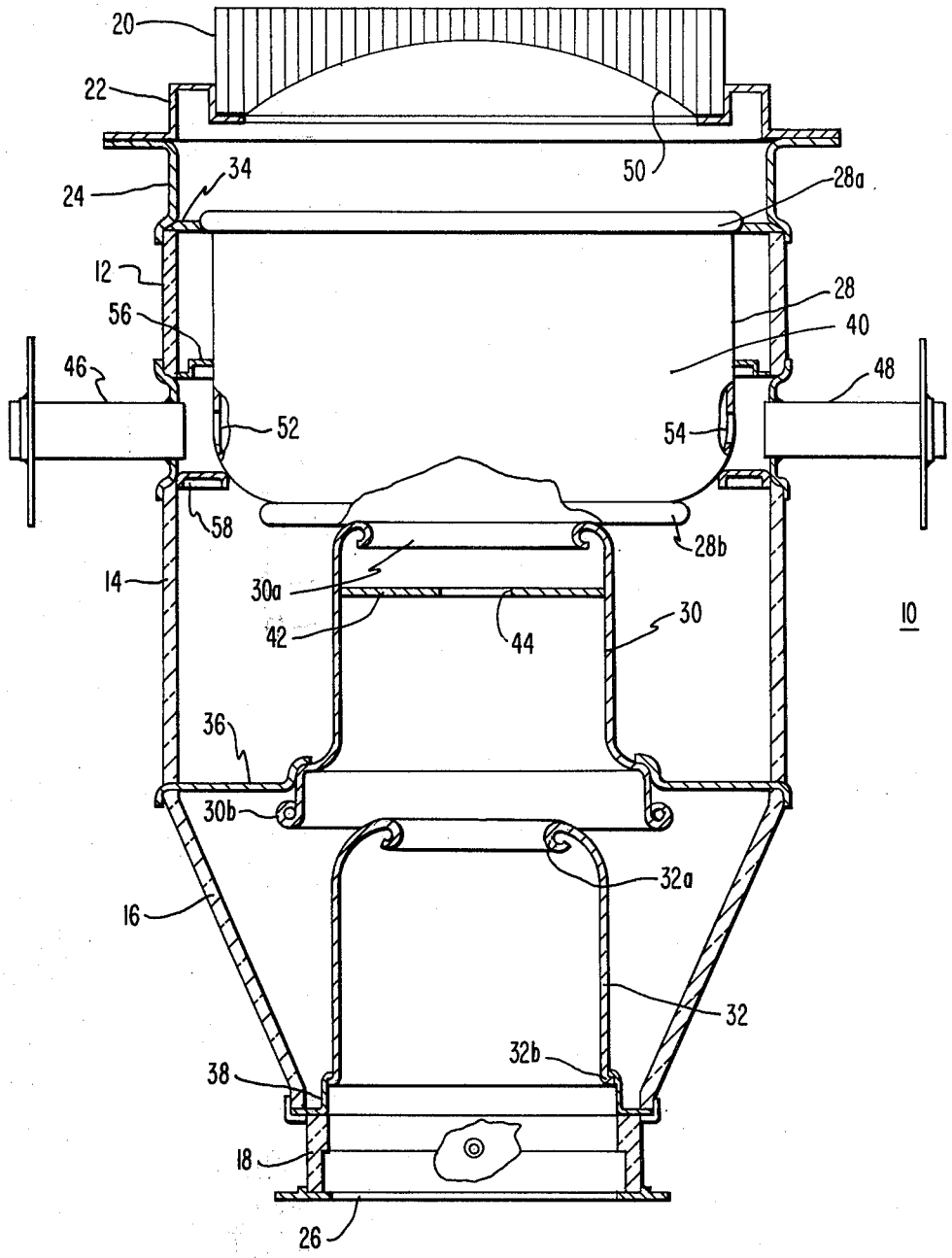
20
22
24
34
50
28a
12
56
28
40
46
48
52
54
58
28b
14
30a
42
44
30
10
36
30b
32a
16
32
32b
38
18
26

IMAGE TUBE

BACKGROUND OF THE INVENTION

The present invention was developed under contract from the Department of the Army.

The present invention relates to an improved image tube in which an optical scene is converted into an electronic signal for transmission or for intensification and subsequent display. In such image tubes a photoconductive target is associated with the optical input portion of the tube. The optical energy associated with the scene viewed is converted by the photoconductor to electrons, and electron beam focus means are associated with the tube to direct and focus the electron beam on a target for generating the electrical signal which represents the scene viewed.

In such image tubes, and particularly in image intensifier tubes the electron beam focus means operate at high voltages of typically 12 to 15 thousand volts for electrical signals of high gain. At high operating voltages a variety of physical phenomenon within the tube can and do give rise to electrical noise signals being generated which interfere with and limit the quality of the desired signal. These physical phenomenon are known to include multiple electron and light reflections, beam distorting electrostatic fields and charge build up, electron field emission, and ion bombardment of the photocathode and target.

One of the most commonly employed photocathodes requires alkali activation to form the photocathode on the interior surface of the tube fiber optic faceplate. This alkali activation is necessarily carried out as one of the last tube fabrication steps, with the tube at reduced pressure of the order of $10^{-7}$ torr. The alkali is typically introduced as a heated vapor through a side arm of the tube envelope, and the alkali is deposited on the photocathode surface. Of course the alkali may deposit on other interior tube surfaces, such as the insulating envelope surface proximate the side arm portion of the envelope. Such alkali deposits, which are conductive, are a source of electrical leakage between the high operating voltage electrodes which can render the tube inoperative. The higher the tube operating voltage the greater the problem caused by such conductive alkali deposits. Alkali deposits on electrode surfaces reduce their intrinsic work function, which makes these surfaces more susceptible to electrical noise phenomena described aobve, such as electron emission. At high operating voltages the electric field between electrodes is high and field emission becomes a factor, competing with true electrical signals.

SUMMARY OF THE INVENTION

An improved image tube has been designed which is operable at higher voltages and consequent higher signal current gain with very low noise levels. This improved image tube has modified generally cylindrical electrodes, with the extending end portions of the electrodes having rolled edge portions which extend away from the cylindrical axis of the electrodes and tube. All electrode surfaces are coated with highly light absorptive insulating material which has a low secondary electron emission characteristic to minimize electron noise signals. This coating adheres to the low secondary electron emission electrode.

A pair of annular shields are disposed within the envelope spaced about the sealable alkali inlet and outlet tubulations to prevent deposition of the alkali on the interior surfaces of the insulating envelope.

The tube envelope comprises a plurality of generally cylindrical ceramic bodies with metallized end surfaces for supporting internally disposed electrodes and the ceramic envelope is sealable in a single pump down fabrication.

In order to achieve noise-free operation in these high operating voltage image tubes, it has been found necessary to confine alkali evolution during tube processing using the tube structure of the present invention, and to configure and coat the electrodes as in the present invention.

BRIEF DESCRIPTION OF THE DRAWING

The sole FIGURE is a side elevational view partly in section of the improved image tube of the present invention.

DESCRIPTION OF THE PREFERRED EMBODIMENT

The present invention can be best understood by reference to the embodiment seen in the sole FIGURE. The image tube 10 comprises a plurality of generally cylindrical ceramic portions 12, 14, 16, and 18 having metallized ends which are respectively sealed together to form a hermetically sealed tube envelope. An image input fiber optic faceplate 20 is sealed via adaptor means 22 to annular support 24 which is sealed to cylindrical ceramic portion 12. An output target 26 is sealed at the opposite end of the tube and may comprise a silicon diode target for generating electrical signals as a function of the input image, and an electron pattern representative thereof is established on this target.

A plurality of generally cylindrical electrodes are aligned disposed within the tube, and include the focus electrode 28 which is closest to the faceplate, a zoom electrode 30, and an anode electrode 32. Each of these electrodes 28, 30, and 32 are supported respectively from the ceramic envelope. Focus electrode 28 is supported by a plurality of support arms 34 which extend from the focus electrode 28, which support arm 34 are supported from and sealed to the end of the ceramic portion 12 where it is sealed to the annular faceplate support 24. A plurality of support arms 36 extend from zoom electrode 30, and are supported by and sealed between the ends of ceramic portions 14 and 16. A plurality of support arms 38 extend from the end of anode electrode 32 proximate the target 26, and are supported from and sealed to the ends of the ceramic portion 16 and 18. Each set of support means 34, 36, and 38 is an electrical conductor which extends through the insulating ceramic envelope, and thereby provides a means of applying the respective operating potential to the respective electrode.

The focus electrode 28 has extending ends terminating in rolled edge portions **28*a*, 28*b*, which extend away from the electrode cylindrical axis. Likewise zoom electrode 30 and anode electrode 32 each have respective rolled edge portions 30*a*, 30*b*, and 32*a*, 32*b*** which extend away from the electrode cylindrical axis. These rolled edge portions minimize high electric field at the electrode ends which might otherwise produce field emission or electron path distortion.

Each of the electrodes 28, 30 and 32 is coated prior to incorporation into the tube with a light absorptive, low secondary emission characteristic black insulating coating 40. This coating 40, is for example aluminum oxide of very small particle size, and is spray coated along with conventional organic vehicle. The vehicle is removed during high temperature bake and before pump down of the tube and prior to sealing on exhaust.

The zoom electrode 30 has the function of permitting magnification of the central portion of the input image using an appropriate potential and electric field for shaping and magnifying the electron beam emanating from the center portion of the photocathode. The zoom electrode 30 has an additional electron beam forming apertured disk electrode portion 42 which is disposed within the cylidrical zoom electrode body 30. This apertured disk electrode portion 42 extends in a direction normal to the tube cylindrical axis. An aperture 44 through this disk electrode 42 is aligned with the tube axis, and is dimensioned to pass the desired focused electron beam to the target, while intercepting stray electrons and keep them from reaching the target.

The tube 10 includes an inlet tubulation 46 and an outlet tubulation 48 which pass through the tube envelope between ceramic portions 12 and 14. These tubulations are open during tube fabrication for pumping down the tube to a low vacuum condition via outlet tubulation 48, and are each sealed to complete tube fabrication. Inlet tubulation 46 is the source of photoconductor activating alkali vapor. The photocathode layer 50 is disposed on the interior spherical surface of the fiber optic faceplate 20, and is a conventional photocathode which requires alkali activation. Apertures 52 and 54 are provided through the side cylindrical wall of the focus electode 28, which apertures 52 and 54 are respectively aligned with the inlet tubulation 46 and outlet tubulation 48. The alkali vapor passes through the inlet tubulation 46 and the inlet aperture 52 to permit deposition on the photoconductor 50.

A pair of annular alkali shields 56 and 58 extend from the ceramic envelope to the focus electrode 28, and such shields 56 and 58 are on either side of the tubulation 46 and 48 to prevent alkali from reaching and depositing on the insulating interior surfaces of ceramic body 12 and 14.

The improved image tube of the present invention is capable of higher voltage and consequent higher gain and increased sensitivity operation over prior art devices. This is very important for such low light level sensing as for astronomical telescope applications and passive satellite tracking as well as medical X-ray sensing The prior art tubes were limited by noise signals to an operating potential of about 12,000 volts and possibly as high as 15,000 volts, while the tube of the present invention permits high sensitivity operation at about 20,000 volts. The gain of the present tube is about 4,800 compared to about 3,000 for prior art tubes.

We claim:

1. An improved image tube which is operable at higher voltage and consequent higher signal gain with low noise levels, which tube comprises:

(a) a plurality of generally cylindrical ceramic envelope portions which are axially aligned and sealed together to form the tube envelope with an input faceplate sealed at one end and an output target sealed at the other end;

(b) a plurality of axially aligned electrode portions disposed within the envelope including a focus electrode and an anode electrode;

the improvement wherein, the extending end portions of each of the electrodes have rolled edge portions which extend away from the cylindrical axis of the electrodes and the tube; and wherein all electrode surfaces are coated with highly light absorptive, low secondary electron emission characteristic, insulating material to minimize electrical noise.

2. The image tube set forth in claim 1, wherein sealable inlet and outlet tubulations are provided through the ceramic envelope proximte the focus electrode, and inlet and outlet apertures are provided in the focus electrode aligned with the inlet and outlet tubulation, and a pair of annular shields are provided extending between the ceramic envelope and the focus electrode spaced on either side of the inlet and outlet tubulations to ensure that alkali vapor introduced through the inlet tubulation does not deposit on the interior surface of the ceramic envelope beyond these annular shields.

3. The image tube set forth in claim 1, wherein a zoom electrode is disposed within the envelope aligned with and between the focus and anode electrodes, and wherein the zoom electrode includes an apertured disk electrode portion within the generally cylindrical zoom electrode, with the disk electrode portion disposed normal to the cylindrical axis, and with the aperture dimensioned to intercept stray electrons but to pass the focus electron beam to the image target.

* * * * *